US005626292A

United States Patent [19]

Armaroli et al.

[11] Patent Number: 5,626,292

[45] Date of Patent: May 6, 1997

[54] INJECTOR WITH HIGH ATOMIZATION CAPACITY

[75] Inventors: Massimo Armaroli, Albani; Roberto Consolini, Volta, both of Italy

[73] Assignee: Magneti Marelli, S.p.A., Italy

[21] Appl. No.: 443,014

[22] Filed: May 17, 1995

[30] Foreign Application Priority Data

May 18, 1994 [IT] Italy ..... BO94A0223

[51] Int. Cl.[6] ..... B05B 7/12

[52] U.S. Cl. ..... 239/408; 239/585.1; 239/409; 239/600

[58] Field of Search ..... 239/585.1, 533.12, 239/585.4, 408, 409, 600

[56] References Cited

U.S. PATENT DOCUMENTS 4,982,716 1/1991 Takeda et al. .
5,193,743 3/1993 Romann ..... 239/409
5,323,966 6/1994 Buchholz ..... 239/408
5,397,061 3/1995 Buchholz ..... 239/408

FOREIGN PATENT DOCUMENTS 4129834 3/1993 Germany .
4205887 9/1993 Germany .

*Primary Examiner*—Robert J. Oberleitner
*Assistant Examiner*—C. T. Bartz
*Attorney, Agent, or Firm*—Myers Liniak & Berenato

[57] ABSTRACT

A fuel injector is disclosed for high atomization capacity, and is of the single-jet air-assisted type in which a stop valve moved by an electromagnetic actuator controls the formation of fuel jets through atomization holes contained in a distributor element after which there is disposed an auxiliary atomization chamber. The auxiliary atomization chamber is delimited internally at least partially by a truncated conical surface onto which there opens substantially radial holes for the provision of auxiliary air, the truncated conical surface being defined by a mixer element disposed with a seal between the distributor element and a cap which is snap-fitted to a casing of the fuel injector.

14 Claims, 3 Drawing Sheets

INJECTOR WITH HIGH ATOMIZATION CAPACITY

BACKGROUND OF THE INVENTION

The present invention relates to an injector with high atomization capacity, controlled electromagnetically, of the single-jet air-assisted type, for the supply of fuel to an engine of a motor vehicle.

In particular, the present invention relates to an injector of the "Pico" type, capable of atomizing the fuel by injecting it through a distributor element capable of producing an outflow through a thin wall.

There are known electromagnetic injectors for supplying vehicle engines in which the injection of the fuel is regulated by an electromagnetic actuator which controls the movement of a stop valve capable of controlling the formation of jets of fuel through atomization holes provided in a distributor element. When the fuel is made to flow out through holes whose length is much less than their diameter, aero-hydrodynamic effects occur in the liquid, atomizing the fuel until it is reduced to very fine particles. By decreasing the thickness of the wall of the distributor element to dimensions of the order of tenths of a millimeter, fuel particles with a diameter of 180–200 micrometers may be obtained. It is difficult to provide more thorough atomization, since a further reduction in the wall thickness is associated with difficulties in construction and problems with clogging and excessive wear of the holes in use. However, there are known devices for improving the atomization of the fuel, in which the atomized jet of fuel is mixed with an auxiliary air flow before being injected into the combustion chamber.

However, the atomizing action obtained with these injectors is not very thorough; moreover, these injectors, because of their structure, have a rather brief service life, generally showing phenomena of rapid wear.

SUMMARY OF THE INVENTION

The object of the present invention is to provide a fuel injector which, being free of the cited disadvantages of the known devices, produces a thorough atomization of the fuel and can be made easily by simply modifying the structure of the known injectors with the addition or substitution of a small number of inexpensive components.

On the basis of the invention it is therefore possible to provide an injector with a high atomization capacity, in particular for the supply of a motor vehicle engine, of the type comprising an electromagnetic actuator, a distributor element provided with at least one atomization hole, a stop valve controlled by the said electromagnetic actuator to control the formation of at least one jet of fuel through the said atomization hole, a casing having one axis of symmetry and housing the said electromagnetic actuator, the said distributor element and the said stop valve, and auxiliary atomization means, disposed immediately after the distributor element and comprising a chamber delimited internally at least partially by a truncated conical surface and into which the said atomization hole opens, and at least one substantially radial hole which has an axis orthogonal to the said truncated conical surface of the said chamber and which has one end opening laterally inside the said chamber and the opposite end communicating with means of supplying an auxiliary air flow, characterized in that the said auxiliary atomization means are carried by a mixer element, defined at least partially by the said truncated conical surface, and by a cap, partially defining the said chamber; the said mixer element being fitted on and axially projecting from the said distributor element, and the said cap being fitted axially on and projecting from the said mixer element externally on the said casing.

BRIEF DESCRIPTION OF THE DRAWINGS

Further characteristics and advantages of the invention will be clearly understood from the following description of two non-restrictive embodiments of the invention, with reference to the attached drawings, in which.

DETAILED DESCRIPTION OF THE INVENTION

Figure 1:
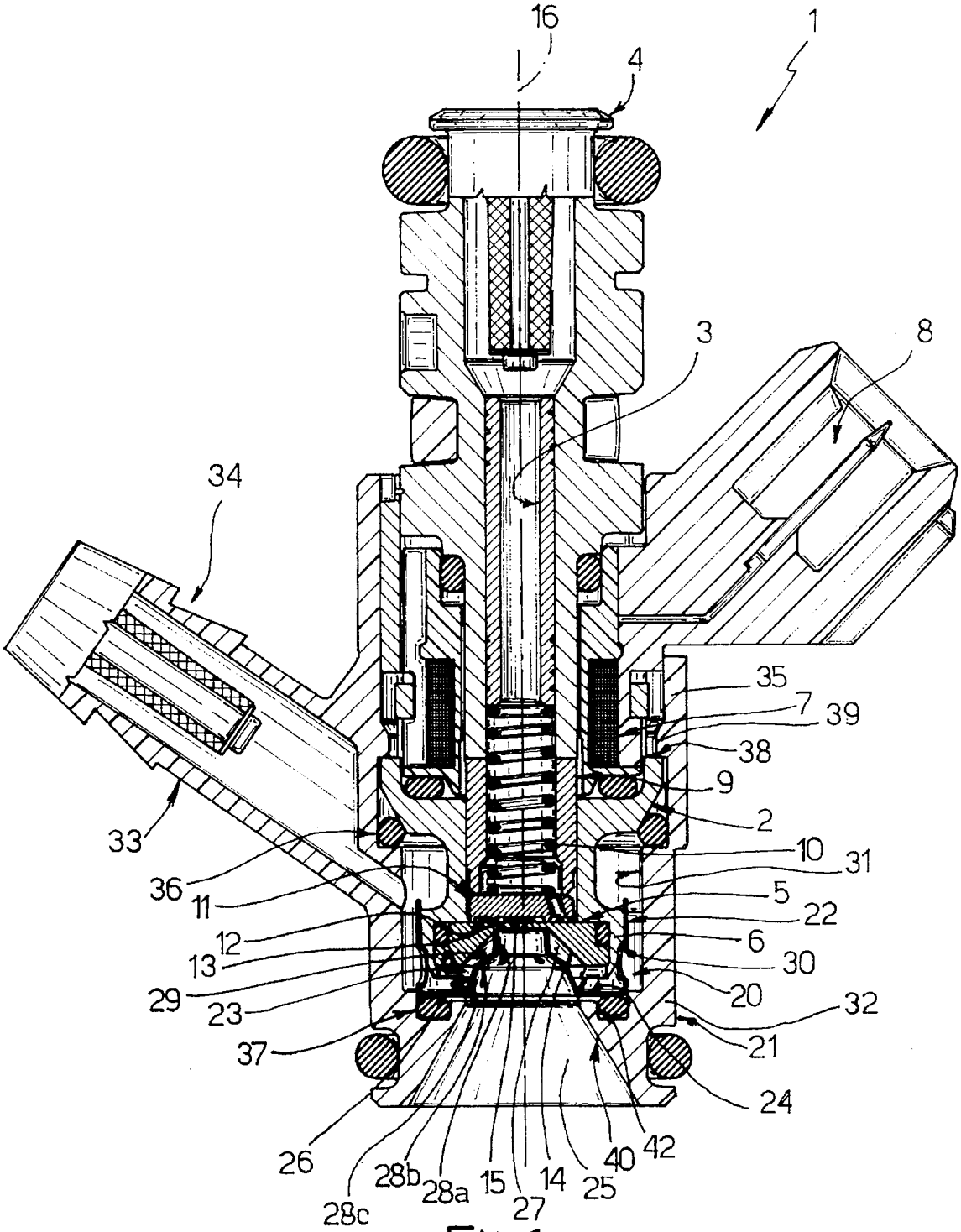
FIG. 1 is a side elevation of a first preferred embodiment of the present invention, in longitudinal section along the axis of the injector.

With reference to the attached figures, the number 1 indicates the whole of a fuel injector, particularly one for the supply of a motor vehicle engine, comprising a casing 2 of a known type inside which is formed a fuel supply duct 3 connected to a known fixing element 4, extending externally from the casing 2 along the same axis; the duct 3 terminates at a fuel distributor element formed by a plate 5 fitted in a known way to form a fluid-tight seal of a lower end 6 of the casing 2, opposite the fixing element 4, which conversely forms the upper end of the casing 2; this has a substantially cylindrical symmetry, so that the duct 3, the fixing element 4 and the plate 5 are disposed in a substantially coaxial arrangement.

Inside the casing 2 there is housed an electromagnetic actuator 7 of a known type, disposed coaxially in the form of a ring around the duct 3 and controlled and supplied through a known electrical connecting element 8 disposed on the outside of the casing 2, near to and on the side of the fixing element 4. The actuator 7 includes a ferromagnetic core 9 which can be moved axially against the action of a spring 10 opposing the action of the electromagnetic actuator 7, and to which is integrally fixed by welding, in the case of the illustrated embodiment, a stop valve 11 formed by a metal disc disposed facing and parallel to the plate 5 forming the cited distributor element.

Annular projections 12 may conveniently be formed on the surface of the stop valve 11 facing the plate 5.

In the non-restrictive example illustrated, the distributor element is of the "thin wall" type, the plate 5 being provided with a central circular portion 13 (FIG. 2) whose thickness is smaller than that of the peripheral wall of the plate 5; this central portion 13 forms the base wall of a truncated conical cavity 14 formed in the plate 5 on the side opposite the stop valve 11, in other words facing the outside of the casing 2. Six atomization holes 15, of a known type, are made through the thin wall formed by the central portion 13; these holes are relatively short with respect to their diameter, and their opening, for a predetermined period, is controlled by an axial sliding movement of the stop valve 11, which in turn is controlled by the movement of the core 9. Although six atomization holes 15 are provided in the embodiment which is described and illustrated, there may be any number of these, but preferably from four to six. When the actuator 7 is de-energized, the stop valve 11 is held by the spring 10 with a fluid-tight seal against the plate 5, thus hydraulically isolating the holes 15 from the duct 3; conversely, when the actuator 7 is energized, the stop valve 11 is moved away from its contact with the plate 5, thus bringing the holes 15 into hydraulic communication with the duct 3, in which pressurized fuel is supplied through the fixing element 4.

In this way, the formation through each hole 15 of a corresponding jet of atomized fuel, which is projected through the lower end 6 of the casing 2, is controlled by energizing the actuator 7 for the said predetermined period; the six holes 15, disposed symmetrically about an axis of symmetry 16 of the injector 1 and with their axes forming a small predetermined angle with the said axis of symmetry 16, are used to form six jets of fuel, slightly diverging with respect to each other, but directed in a predominantly axial direction with respect to the direction of sliding of the stop valve 11.

According to the present invention, the injector 1 also comprises auxiliary atomization elements disposed immediately after the distributor element 5, with respect to the direction of supply of the fuel jets, axially abutting the distributor element on the side opposite the stop valve 11.

According to the preferred embodiments of the invention described and illustrated here, the said auxiliary atomization elements are carried by a mixer element 20 and by a cap 21, independent of the casing 2 and mounted coaxially with it. In particular, the mixer element 20 is disposed on and axially projecting from the distributor element 5 and the cap 21 is mounted axially on and projects from the mixer element 20 and externally on the casing 2 at the lower end 6 of the casing.

In particular, the mixer element 20 consists of sheet metal, shaped preferably by a spinning operation, comprising an outer wall 22 of cylindrical form, an inner wall 23 in the form of a truncated cone coaxial with the wall 22, and an annular wall 24 extending substantially radially to connect a greater base of the wall 23 to the wall 22.

As shown in the attached figures, the cylindrical wall 22 is connected with a seal to the outside of the lower end 6 of the casing 2 and has an axial dimension greater than that of the wall 23 so that it also forms a means of centring the mixer element 20 on the casing 2. The truncated conical wall 23 also delimits a central supply duct, partially defining a chamber 25 of predetermined dimensions, and has a free end which is inserted into the cavity 14 of the plate 5. In particular, the wall 23 is delimited externally by a conical surface 26 having a lesser conicity than that of the cavity 14, so that, when the mixer element 20 is fitted on the casing 2, the free end of the wall 23 is made to bear in a fluid-tight way on the central portion 13 of the plate 5, and an annular void 27 is formed between the conical surface 26 of the said wall 23 and that of the cavity 14.

Figure 2:
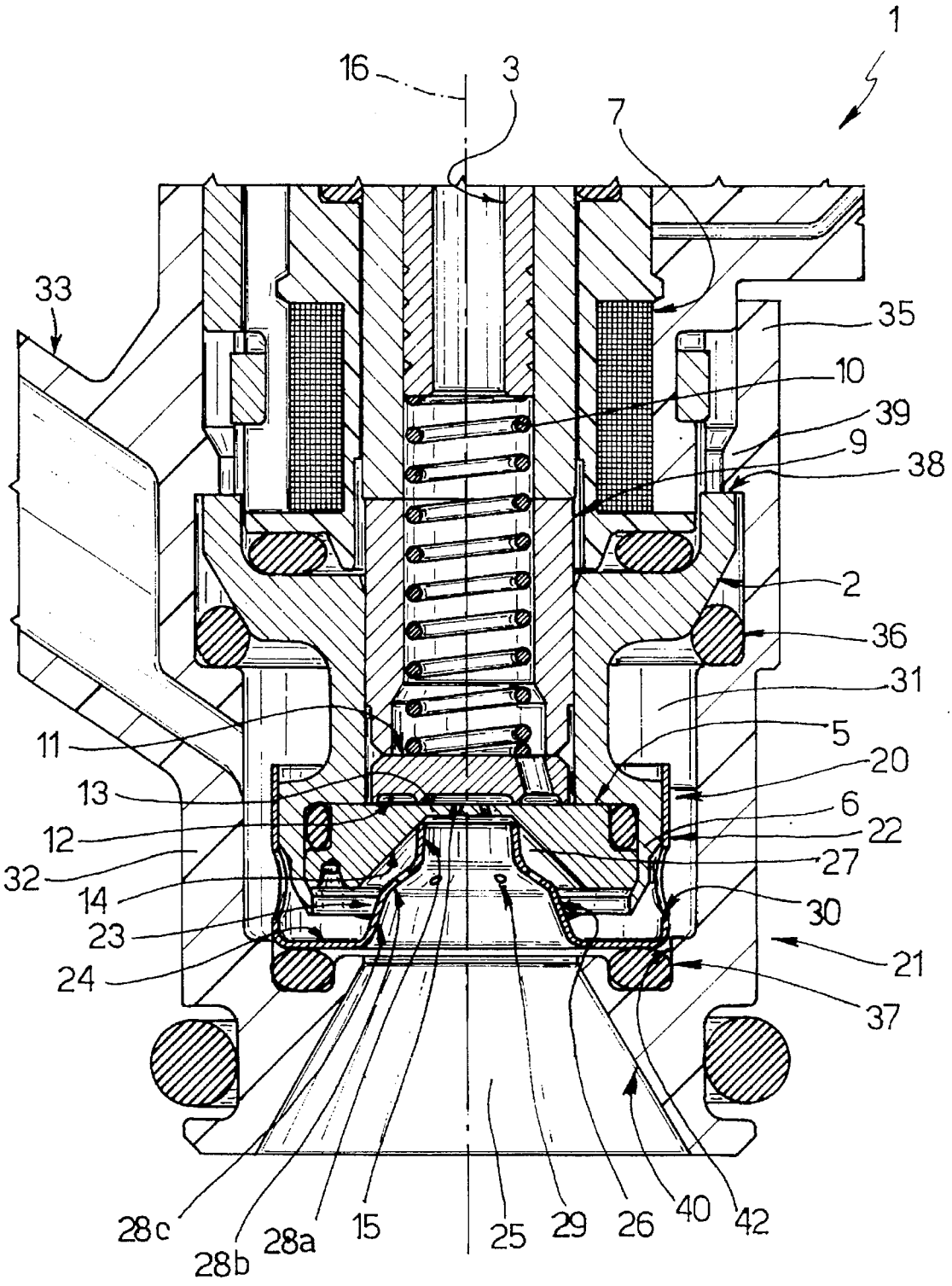
FIG. 2 shows, on an enlarged scale and in section, a detail of the injection end of the injector shown in FIG. 1.

As shown in FIG. 2, the wall 23 is delimited internally by a succession of different truncated conical surfaces 28*a*, 28*b*, 28*c*.

As clearly shown by the said FIG. 2, substantially radial holes 29, formed in the wall 23 and capable of supplying an auxiliary air flow, open laterally into the chamber 25. According to the preferred embodiment described here, the radial holes 29 are six in number and are disposed symmetrically in a ring around the axis 16 of the casing 2, preferably with the same configuration as that in which the atomization holes 15 are disposed with respect to the said axis 16, at a predetermined axial distance from the distributor element 5. The holes 29 are oriented so that they direct corresponding jets of auxiliary air towards a point of interception of the jets of fuel, this point also being situated at a predetermined axial distance from the distributor element 5. In particular, the holes 29 are oriented obliquely with respect to the axis 16 of symmetry of the casing 2, so that they converge towards the axis 16 in the direction of the supply of the fuel. Additionally, the holes 29 have corresponding axes orthogonal to the surface 28*b* of the chamber 25, so that the line of intersection between the surface 28*b* and the cylindrical surface delimiting each hole 29 becomes substantially circular. Each of the holes 29, made to pass through the wall 23, has, as stated above, one end opening laterally inside the chamber 25 and an opposite end communicating with the annular void 27 located between the plate 5 and the mixer element 20.

In turn, the annular void 27 communicates with supply holes 30 for the auxiliary air, which extend radially through the cylindrical wall 22 of the mixer element 20 and open into a gap 31 located in an interstitial space lying substantially between the inner surface of a tubular portion 32, which connects the cap 21 to the casing 2, and the outer surface of the casing 2. In particular, these holes 30 have corresponding axes substantially orthogonal to the generatrix of the cylinder defined by the wall 22, are six in number, and are disposed around the axis 16 with the same configuration as that of the holes 29.

With particular reference to the first embodiment illustrated here (FIGS. 1 and 2), the gap 31 communicates with the suction manifold of the engine through a duct 33 which has one end opening laterally inside the gap 31 and an opposite end provided with locking means 34 (FIG. 1) for connection to a duct, not illustrated, which may be a flexible tube, and which runs from the suction manifold of the engine.

The cap 21, preferably made of plastic material, is snap-fitted to the casing 2 so that it retains the mixer element 20 in the position described, and so that it defines the gap 31 around the casing 2, by means of the fluid-tight fitting provided by a seal 36 (interposed between the tubular portion 32 and the casing 2) and by a seal 37 (interposed between the cap 21 and the mixer element 20). The cap 21 has an annular seat 42 in which is partially housed the wall 22 of the mixer element 20 to dispose this element so that it bears axially on the seal 37 fitted in the seat 42. The snap-fitting of the cap 21 is provided by the interaction between a shoulder 38 of annular shape, formed on the casing 2, and a tooth 39, carried by a tubular appendage 35 which extends integrally in the axial direction towards the fixing element 4 of the tubular portion 32. FIGS. 1 and 2 also show that the cap 21 has an internal cavity in the shape of a truncated cone coaxial with the axis 16 and delimited internally by a conical surface 40, which, in turn, being provided with a conicity substantially equal to that of the surface 28*c*, forms, with the wall 23, the chamber 25.

In operation, the auxiliary air flow taken from the suction manifold of the engine (not illustrated) and guided by the duct 33 into the gap 31, passes through the holes 30 in the annular void 27 and is introduced through the substantially radial holes 29 into the chamber 25 to intercept in a predetermined way the jets of fuel which are thus re-atomized until the fuel particles have characteristic dimensions considerably smaller than those obtainable by simple atomization through a thin wall.

Figure 3:
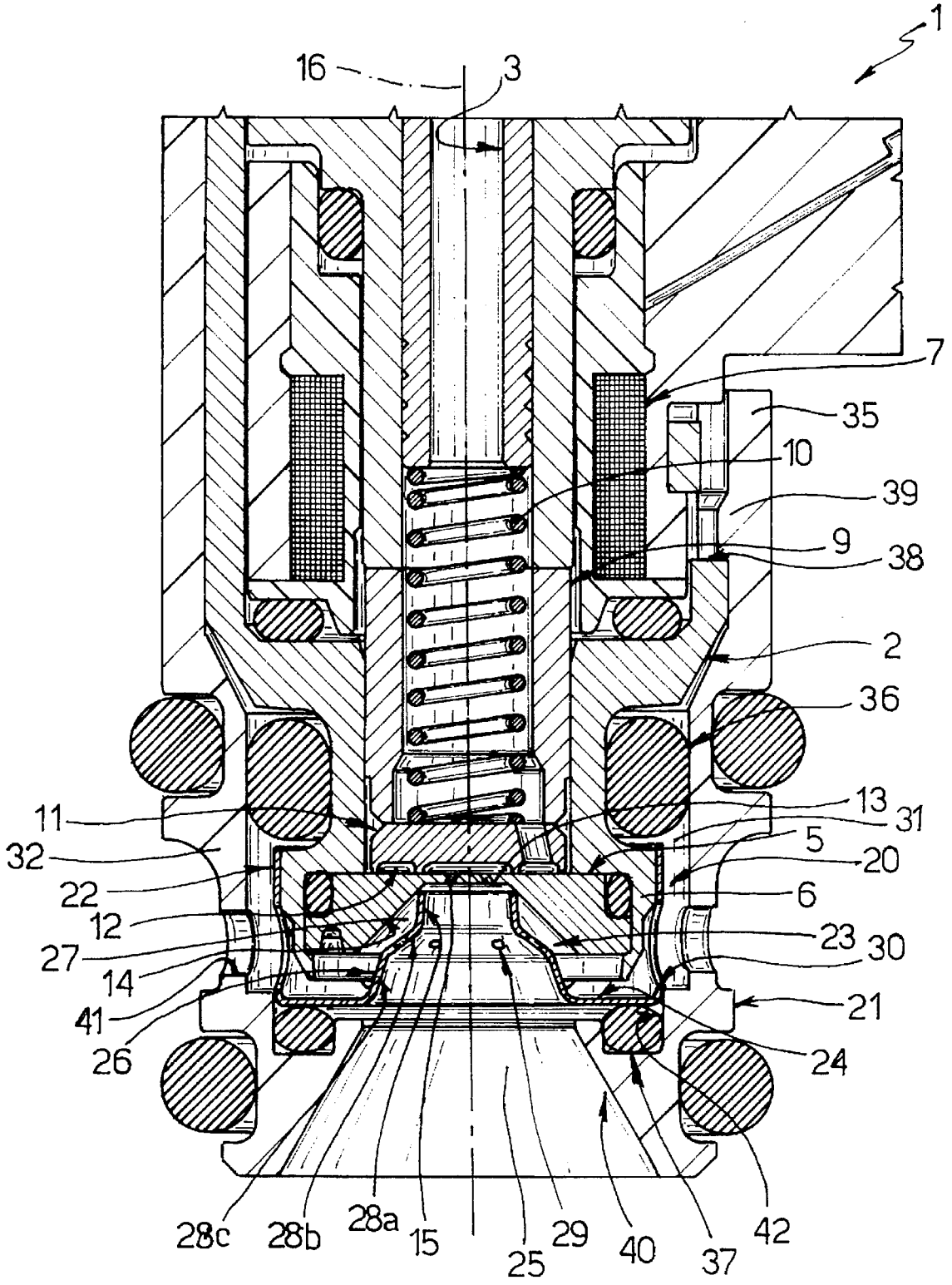
FIG. 3 shows, on an enlarged scale and in section, a detail of the injection end of a second preferred embodiment of the present invention.

FIG. 3 shows a second preferred embodiment of the present invention, of which only the characteristic elements distinguishing it from the first embodiment are described in the following text, with the additional information that the numerical markings previously used to indicate similar and corresponding parts or functionally related components are used in the following description.

With particular reference to FIG. 3, it will easily be seen that in the second preferred embodiment of the present invention the gap 31, lying substantially between the inner surface of the tubular portion 32 and the wall 22 of the mixer element 20, communicates directly, through ducts 41, with an auxiliary air manifold (not illustrated), which in turn is connected, in a way which for the sake of simplicity is not shown, to the suction manifold of the engine. These ducts 41 are formed radially in the cap 21 next to the holes 30 made in the cylindrical wall 22 of the mixer element 20.

In all cases, the operation of this second preferred embodiment is substantially unchanged from that described previously for the first embodiment. In this case also, an auxiliary air flow, passing through the ducts 41, the gap 31 and the annular void 27, is introduced into the chamber 25 through the holes 29 to atomize thoroughly the fuel jets arriving from the distributor element and directed to the engine.

From the description it will be evident that the injector 1 which is the object of the present invention is capable of generating a markedly high degree of atomization of the fuel, without the central portion 13 of the plate 5 being made so thin that it is difficult to construct, and without the need to reduce the atomization holes 15 to sizes such that they are subject to obstruction in use. Moreover, no component of the injector 1 is subjected to conditions which may produce excessive wear in it.

The possibility that the auxiliary atomization means are formed by components such as the mixer element 20 and the cap 21, which are mounted, so as to be removable, externally on the casing 2, enables a conventional "Pico" injector to be converted, without the necessity of modifications, and with convenient mounting operations, to form the injector of the present invention, with a considerable improvement in performance for a low increase in cost. The mixer element 20 and the cap 21 are made in a form which, for the reasons stated above, makes the correct application to the casing 2 simple and secure; moreover, they are distinctively made from materials which increase the advantageous characteristics. In particular, the metallic material forming the mixer element 20 provides the latter with high resistance to wear and enables the dimensions of the holes 29 and the holes 30 to be defined very precisely; the plastic material of the cap 21, on the other hand, permits a considerable reduction in the cost of the cap and also permits the advantageous use of a snap-fitting connection of the auxiliary atomization means to the casing 2.

It will be evident that modifications and variations may be made to the device described above without departure from the scope of protection of the present invention.

We claim:

1. Injector with a high atomization capacity, in particular for the supply of a motor vehicle engine, the injector comprising:

an electromagnetic actuator;

a distributor element provided with at least one atomization hole;

a stop valve controlled by said elelctromagnetic actuator to control the formation of at least one jet of fuel throughout said atomization hole;

a casing having one axis of symmetry and housing said electromagnetic actuator, said distributor element and said stop valve;

auxiliary atomization means disposed immediately after the distributor element and comprising a chamber (25) delimited internally at least partially by a truncated conical surface (**28*b*) into which said atomization hole opens, and at least one substantially radial hole (29**) which has an axis orthogonal to said truncated conical surface and which has one end opening laterally inside said chamber and the opposite end communicating with means for supplying an auxiliary air flow;

wherein said auxiliary atomization means is carried by a mixer element, said mixer element being defined at least partially by said truncated conical surface, and by a cap partially defining said chamber;

wherein said mixer element is fitted on and axially projects from said distributor element, and said cap being fitted axially on and projecting from said mixer element externally on said casing;

wherein said distributor element comprises a plate fixed to said casing, said plate being provided with a central portion through which said at least one atomization hole is made, and said plate having a cavity (14) disposed after said at least one atomization hole and delimited by a first conical surface; and wherein said mixer element includes a truncated conical wall (23) that includes said truncated conical surface (**28*b*) and is delimited externally by another conical surface (26), wherein said wall (23) is inserted into said cavity of said plate in such a way that said mixer element forms a fluid-tight seal between said first truncated conical surface of the distributor element and said truncated conical wall (23) of said mixer element, said another conical surface (26) having a lesser conicity than that of said first conical surface of the cavity (14) so as to form between said first conical surface and said another conical surface (26) an annular void (27**) of pre-determined dimensions into which said auxiliary air flow emerges.

2. Injector according to claim 1, characterized in that it comprises a plurality of atomization holes (15), disposed in a predetermined configuration around the said axis (16) of symmetry of the said casing (2), and in that it comprises a number of the said substantially radial holes (29) equal to the number of the said atomization holes (15); the said substantially radial holes (29) being disposed around the said axis (16) of symmetry of said casing (2) according to choice, with the same configuration as that of the said atomization holes (15) with respect to the said axis (16) of symmetry or with a configuration out of alignment with that of the said atomization holes (15).

3. Injector according to claim 2, characterized in that the said substantially radial holes (29) are oriented in such a way that they direct a corresponding auxiliary air jet towards a point of interception of the said fuel jet which is located at a predetermined distance from the said atomization holes (15).

4. Injector according to claim 2, characterized in that the said substantially radial holes (29) are oblique with respect to the said axis (16) of symmetry of the said casing (2) and converge towards it in the direction of supply of the fuel.

5. Injector according to claim 1, characterized in that the said substantially radial holes (29) are made in the said truncated conical wall (23) to bring the said annular void (27) into communication with the said chamber (25).

6. The injector of claim 1 wherein said conical wall (23) interiorly includes a plurality of successive and different truncated conical surfaces including second surface (**28*a*), said truncated conical surface (28*b*), and third surface (28*c*), with said third surface (28*c*) being located furthest from said distributor element, and said substantially radial hole (29) opens on one (28*b*) of said plurality of conical surfaces (28*a*, 28*b*, 28*c***).

7. The injector of claim 1 further including means (38, 39) for snap fitting said cap to said casing.

8. Injector according to claim 6, characterized in that the said cap (21) comprises a fourth conical surface (40), partially delimiting the said chamber (25) and having a conicity substantially equal to the conicity of one (28*c*) of the said plurality of conical surfaces (28*a*, 28*b*, 28*c*) which belong to the said second conical surface and delimit internally the said truncated conical wall (23) of the said mixer element (20).

9. Injector according to claim 1, characterized in that the said mixer element (20) comprises a cylindrical wall (22) fitted with a seal on an outer side of the said casing (2) of the said injector (1).

10. Injector according to claim 9, characterized in that the said means of supply of an auxiliary air flow (30) comprise at least one supply hole (30) for the air, made through the said cylindrical wall (22).

11. Injector according to claim 10, characterized in that the said means of supply of an auxiliary air flow (30) comprise a plurality of supply holes (30) for the air, disposed in a predetermined configuration around the said axis (16) of symmetry of the said casing (2); the said air supply holes (30) being disposed around the said axis (16) of symmetry with the same configuration as that of the said substantially radial holes (29).

12. Injector according to claim 11, characterized in that the said substantially radial holes (29) and the said air supply holes (30) are seven in number.

13. Injector according to claim 11, characterized in that it comprises a gap (31) disposed between the said cylindrical wall (22) of the said mixer element (20) and the said cap (21); the said gap (31) communicating with the said annular void (27) through the said air supply holes (30).

14. Injector according to claim 1, characterized in that the said mixer element (20) is made of metallic material and the said cap (21) is made of plastic material.

* * * * *